US005322491A

United States Patent [19]

Wanzer et al.

[11] Patent Number: 5,322,491

[45] Date of Patent: Jun. 21, 1994

[54] EXERCISE APPARATUS WITH RECIPROCATING LEVERS COUPLED BY RESILIENT LINKAGE FOR SEMI-DEPENDENT ACTION

[75] Inventors: Richard A. Wanzer, Bothell; Cole J. Dalton, Snohomish; Soddy Tsang, Seattle, all of Wash.

[73] Assignee: Precor Incorporated, Bothell, Wash.

[21] Appl. No.: 903,991

[22] Filed: Jun. 23, 1992

[51] Int. Cl.[5] ..... A63B 1/00

[52] U.S. Cl. ..... 482/52

[58] Field of Search ..... 482/51, 52, 53, 129

[56] References Cited

U.S. PATENT DOCUMENTS

| | | | |
|---|---|---|---|
| 511,251 | 12/1893 | Pickles . | |
| 3,337,215 | 8/1967 | Melchiona | 272/83 |
| 3,650,528 | 3/1972 | Natterer | 272/57 B |
| 3,970,302 | 7/1976 | McFee | 272/130 |
| 4,231,568 | 11/1980 | Riley et al. | 272/136 |
| 4,618,139 | 10/1986 | Haaheim | 272/70 |
| 4,659,075 | 4/1987 | Wilkinson | 272/70 |
| 4,708,338 | 11/1987 | Potts | 272/70 |
| 4,783,069 | 11/1988 | Cottee | 272/97 |
| 4,838,543 | 6/1989 | Armstrong et al. | 272/70 |
| 4,934,688 | 6/1990 | Lo | 272/70 |
| 4,938,474 | 7/1990 | Sweeney et al. | 482/52 |
| 4,943,049 | 7/1990 | Lo | 272/70 |
| 4,949,993 | 8/1990 | Stark et al. | 272/70 |
| 4,953,850 | 9/1990 | Lo | 272/73 |
| 4,969,642 | 11/1990 | Phillips | 272/73 |
| 4,979,731 | 12/1990 | Hermelin | 272/70 |
| 5,007,631 | 4/1991 | Wang | 272/70 |
| 5,013,031 | 5/1991 | Bull | 272/70 |
| 5,039,088 | 8/1991 | Shifferaw | 272/73 |
| 5,058,882 | 10/1991 | Dalebout et al. | 272/70 |
| 5,060,935 | 10/1991 | Dunn et al. | 272/70 |
| 5,114,388 | 5/1992 | Trulaske | 482/52 |
| 5,135,447 | 8/1992 | Robards, Jr. et al. | 482/52 |
| 5,180,351 | 1/1993 | Ehrenfried | 482/52 |

FOREIGN PATENT DOCUMENTS

| | | | |
|---|---|---|---|
| 3916638A | 11/1990 | Fed. Rep. of Germany | A63B 69/18 |
| 1065278A | 4/1984 | U.S.S.R. | B62M 1/04 |
| 0024506 | of 1908 | United Kingdom | 482/129 |

OTHER PUBLICATIONS

TRU-CLIMB 450 TM Brochure, Alpine Life Sports, Suffolk, Va., 2 pages.

TRU-CLIMB 300 TM Brochure, Alpine Life Sports, Suffolk, Va., 2 pages.

TRU-CLIMB 100HF TM Brochure, Alpine Life Sports, Suffolk, Va, 2 pages.

Unpublished sketch of Alpine Life Sports Tru-Climb pedal linkage mechanism (as understood by applicants), 1 page.

*Primary Examiner*—Stephen R. Crow

*Attorney, Agent, or Firm*—Christensen, O'Connor, Johnson & Kindness

[57] ABSTRACT

An exercise apparatus (10) includes a frame (12) on which left and right levers (14) and (16) are pivotally mounted. A resistance mechanism (18) resists pivoting of the levers between nominal and displaced positions. The levers are coupled by a linkage (20), including an elongate coil spring (22) and an internal extension-limiting cable (24). The linkage normally acts to urge each of the first and second levers toward its respective nominal position when the other of the first and second levers is in a displaced position. The coil spring is capable of elongating to permit limited non-synchronous motion of the left and right levers, with the elongation of the coil spring being limited by the presence of the extension-limiting cable.

17 Claims, 8 Drawing Sheets

Fig. 3.
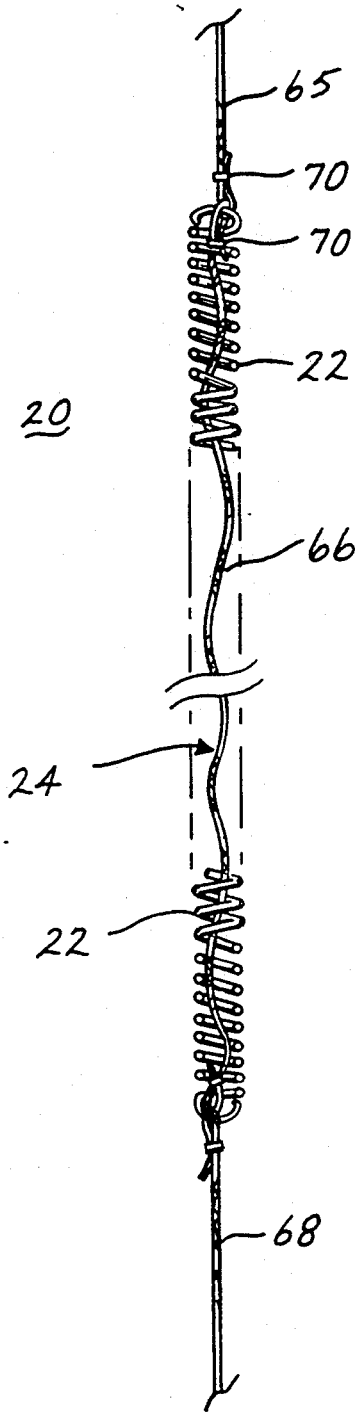
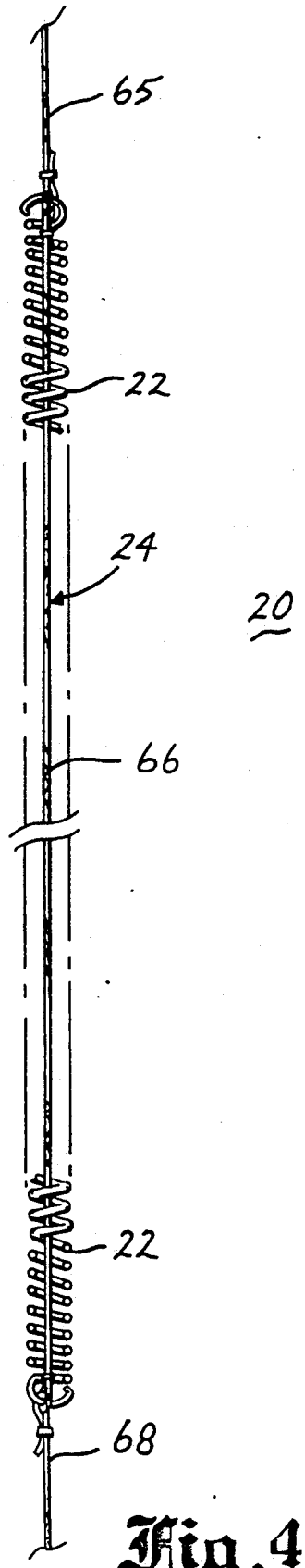
Fig. 4.

EXERCISE APPARATUS WITH RECIPROCATING LEVERS COUPLED BY RESILIENT LINKAGE FOR SEMI-DEPENDENT ACTION

FIELD OF THE INVENTION

The present invention relates to exercise apparatus, more particularly to exercise apparatus with first and second levers operated by an exerciser's first and second limbs, and still more particularly to exercise apparatus wherein reciprocating levers are coupled by a resilient linkage to enable semi-dependent action of the levers.

BACKGROUND OF THE INVENTION

Various exercise devices have been developed to strengthen an exerciser's musculature and improve his or her aerobic conditioning. Often these devices include left and right reciprocating members that are pivotally or slidably secured to a frame and reciprocated by the exerciser's legs, arms, or legs and arms. In particular, many devices have been developed including two reciprocating platforms or levers that are alternately depressed by an exerciser's legs to simulate stair climbing.

Conventional exercise apparatus with dual reciprocating members often include a linkage mechanism coupling the members together for completely dependent action. The linkage mechanism forces one member to move in the direction opposite of the other member during use. One such example is the exercise climber disclosed by U.S. Pat. No. 5,013,031 to Bull. Left and right reciprocating levers are connected by a rope and pulley system, such that when one lever is in the lowest position, the other lever is forced to the highest position, and vice-a-versa. Such conventional dependent systems act to impose synchronization on the exerciser's limbs, ensuring that each limb is exercised through the same range of motion and at the same speed.

The rigidity and inflexibility of such systems is not as appealing to some exercisers who may wish to exercise with a certain degree of unevenness. For instance, some exercisers may find it more natural to take greater or faster strides with one limb versus the other. To accommodate such action, other conventional exercisers have been developed that include independently operating first and second reciprocating members. One example is disclosed by U.S. Pat. No. 4,708,338 to Potts, which discloses a stair climbing exercise device including independently operating left and right levers. While enabling exercisers a greater degree of freedom in determining their strides, such independent action exercise devices may be undesirable for exercisers with less coordination or who wish to ensure that both of their limbs are subjected to the same degree of exercise.

It is thus desirable to provide an exercise device including a linkage mechanism that normally constrains the first and second reciprocating members to move in synchrony, while also enabling a limited degree of non-synchronous motion. One conventional manner for achieving this goal is embodied in a climber sold by Alpine Life Sports under the designation mark Tru-Climb 450 TM. The Alpine climber includes a pulley mounted to the frame by a coil spring to enable the pulley to slide relative to the frame. Reciprocating step platforms are engaged with the pulley to enable non-synchronous motion. While such spring-mounted pulley climbers provide a more flexible system, the movable mounting of the pulley is somewhat complex, and therefore costly. Additionally, shear forces exerted on the pulley by the belt, when coupled with the loose tolerance required to enable the pulley to slide, may potentially result in undesirable wear of the system.

Thus, it is desired to construct an exercise apparatus wherein first and second reciprocating members are connected by a simple, reliable linkage permitting semi-dependent motion of the members. It is further desired to provide an exercise apparatus wherein the degree of non-synchronous motion of the first and second members is limited by the linkage so that, after a predetermined extent of non-synchronous motion has occurred, the first and second members are constrained to move in a dependent fashion.

SUMMARY OF THE INVENTION

The present invention provides an exercise apparatus including a frame and first and second members mounted to the frame for reciprocal motion between a nominal position and a displaced position when operated by an exerciser's first and second limbs, respectively. A resistance mechanism is coupled to at least one of the first and second members to resist motion of the first and second members. A synchronizing linkage couples the first and second members to urge each of the first and second members to its respective nominal position when the other of the first and second members is in its displaced position. The linkage includes a resilient portion that is deformable for elongation or flexure of the linkage, to permit limited non-synchronous motion of the first and second members.

In a first preferred embodiment of the present invention, the linkage includes a coil spring coupling the first lever to the second lever, and an extension-limiting cable connected across the ends of the coil spring. The extension-limiting cable has a length greater than the nominal, unstretched length of the spring to limit the maximum extension of the spring.

In a further embodiment of the present invention, an exercise apparatus includes a frame and first and second levers pivotally mounted to the frame for reciprocal motion between a nominal position and a displaced position. The apparatus includes a resistance mechanism coupled to at least one of the first and second levers for resisting motion of the first and second levers. A synchronizing linkage couples the first lever to the second lever to constrain each of the first and second levers to move to its respective nominal position when the other of the first and second levers is moved to its displaced position. The apparatus further includes an arcuate leaf spring having a first end secured to the frame and a second end engaged with the linkage, wherein deformation of the leaf spring enables limited non-synchronous motion of the first and second levers.

In another embodiment of the present invention, an exercise apparatus includes a frame and first and second levers rotatably mounted on the frame for reciprocal rotation about a first axis between a nominal position and a displaced position when operated by an exerciser's first and second limbs, respectively. The apparatus includes a resistance mechanism coupled to at least one of the first and second levers for resisting motion of the first and second levers. A rocker arm is mounted to pivot about a central location, and the distal ends of the rocker arm are coupled to the first and second levers, respectively, to synchronize motion of the first and second levers. As a result, each of the first and second levers is urged to its respective nominal position when the other of the first and second levers is in its displaced position. The apparatus further includes a resilient mechanism for mounting the rocker arm to the frame to enable displacement of the pivot axis of the rocker arm.

The present invention thus provides exercise apparatus wherein first and second reciprocating members are linked by a linkage that normally acts to synchronize movement of the first and second members in dependent fashion. However, when a differential resistance is exerted on one member relative to the other member, the linkage deforms to enable a limited degree of non-synchronous motion of one member relative to the other member, thereby providing a "semi-dependent," or "semi-independent," action. The degree of non-synchronous motion is limited by the resistance to deformation of the linkage and/or the deformation limiting portion of the linkage, thereby ensuring that dependent action ultimately occurs during each reciprocation of the members.

The present invention ensures that both of the exerciser's limbs are exercised to a substantially equal extent, and provides substantial synchronization of an exerciser's limbs for exercisers who may otherwise have difficulty coordinating motion of their limbs. However, at the same time the exerciser is permitted a limited degree of freedom to move his or her limbs in a non-synchronous nature, thereby accommodating exercisers with differing strides of one limb relative to the other limb. Further, the mechanism urges the exerciser's limbs into synchronous motion without imparting shock to the exerciser's limbs at the ends of the range of travel of the apparatus levers, due to the shock-absorbing effect of the deformable linkage.

BRIEF DESCRIPTION OF THE DRAWINGS

The foregoing aspects and many of the attendant advantages of the present invention will become more readily appreciated as the same becomes better understood by reference to the following detailed description, when taken in conjunction with the accompanying drawings, wherein:

FIGS. 3 and 4 provide detailed views of the coil spring and interconnecting cable linkage used in the apparatus of FIG. 1 in the relaxed and extension-limited configurations, respectively, with the ends of the coil spring shown in cross section and the center portion of the coil spring shown schematically;

DETAILED DESCRIPTION OF THE PREFERRED EMBODIMENTS

Figure 1:
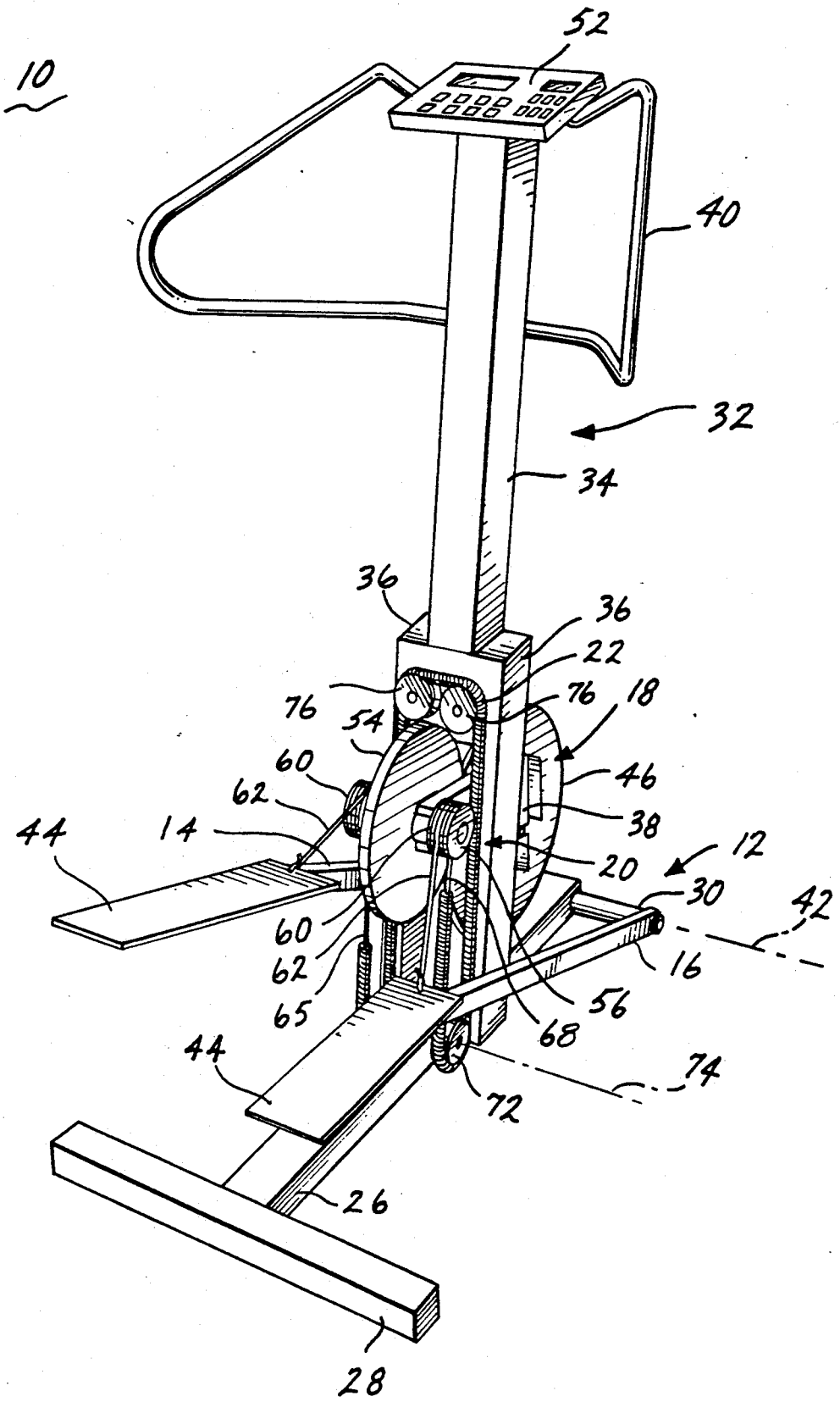
FIG. 1 provides a pictorial view of a first preferred embodiment of an exercise apparatus constructed in accordance with the present invention, wherein first and second levers are interconnected by a coil spring including an extension-limiting cable.
Figure 2:
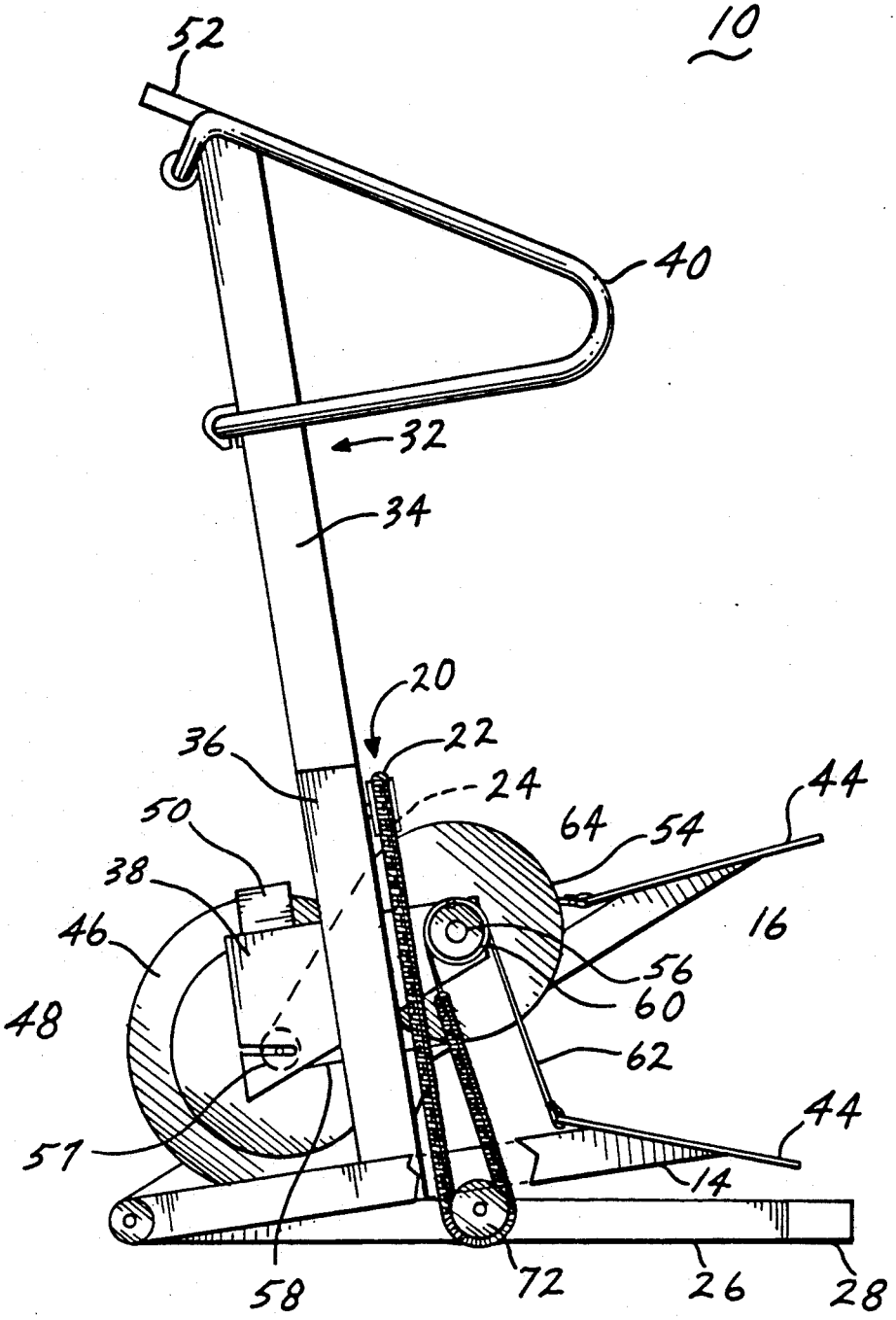
FIG. 2 provides a side elevation view of the exercise apparatus of FIG. 1.

A first preferred embodiment of an exercise apparatus 10 constructed in accordance with the present invention is shown in FIGS. 1 and 2. The apparatus includes a frame 12 to which the forward ends of left and right levers 14 and 16 are mounted to pivot up and down. A resistance mechanism, such as an eddy current brake assembly 18, resists the pivoting of the levers 14 and 16 between their nominal and displaced positions. The levers 14 and 16 are coupled by a linkage assembly 20 including an elongate coil spring 22 and an internal extension-limiting cable 24 (shown in phantom in FIG. 2). The linkage assembly 20 normally acts to urge each of the first and second levers to its normal position when the other of the first and second levers is in its displaced position. When a sufficient differential downward force is exerted on the left and right levers 14 and 16, the coil spring 22 elongates to permit limited non-synchronous motion of the left and right levers. Elongation of the coil spring 22 is limited by the extension-limiting cable 24 being pulled taut.

The frame 12 includes a base constructed from a longitudinal center beam 26, rearward transverse beam 28 and forward transverse shaft 30. As used herein throughout, forward refers to the direction in which an exerciser typically faces during use of the apparatus, i.e., towards the forward transverse shaft 30, while rearward refers to the opposite direction. The frame further includes an upright post assembly 32 that projects upwardly from the center beam 26 in proximity to the forward transverse shaft 30. The upright post assembly 32 is constructed from structural members, such as hollow rectangular tubing. The upright post assembly 32 includes an upper beam 34. Left and right lower beams 36 are secured on opposite sides of the lower end of the upper beam 34, and project downwardly therefrom. A gap created between the lower beams 36 accommodates placement of the eddy current break assembly 18. The base center beam 26 is secured between the lower ends of the lower beams 36.

The frame 12 further includes left and right, generally triangular mounting plates 38 secured to the inner surfaces of the respective lower beams 36. The mounting plates 38 each project forwardly and rearwardly of the upper post assembly 32, and taper in the rearward direction. A formed handrail 40 is secured to the upper end of the upright post assembly 32, and projects transversely outward and rearwardly therefrom.

The left and right levers 14 and 16 are pivotally secured to corresponding ends of the forward transverse shaft 30 to pivot about an axis 42. The levers 14 and 16 project rearwardly from the forward transverse shaft 30, and each terminate in a generally horizontally disposed foot platform 44. An exerciser stands on the platforms 44 and alternately depresses the left and right levers 14 and 16. The left and right levers 14 and 16 reciprocate between a nominal, upper position, in which the right lever 16 is shown in FIG. 2, and a lower, displaced position, in which the left lever 14 is shown FIG. 2.

The eddy current brake assembly 18 provides resistance to rotation of the levers 14 and 16. The eddy current brake assembly 18 operates in conjunction with a momentum-generating device, such as a flywheel 46 journaled on bearings (not shown) to a transverse shaft 48 between the forward ends of the mounting plates 38. Rotation of the flywheel 46 is resisted by a conventional eddy current brake 50, mounted on top of the forward ends of the mounting plates 38 to straddle the flywheel 46. Power to, and braking force generated by, the eddy current brake 50 is controlled by a microprocessor (not shown) housed within an electronic exerciser interface 52 mounted to the top of the upright post assembly 32 (FIG. 1). The flywheel 46 is rotationally driven by a step-up pulley 54 that is journaled on bearings (not shown) to a transverse drive shaft 56 between the rearward ends of the mounting plates 38. The step-up pulley 54 is engaged with a smaller driven pulley 57 mounted on the flywheel shaft 48 beside the flywheel 46. A belt 58 interconnects the two pulleys 54 and 57 to increase the speed of rotation of the flywheel 46 relative to the speed of rotation of the drive shaft 56.

Referring still to FIGS. 1 and 2, left and right spiral-grooved drive pulleys 60 are rotatably mounted by one way clutches (not shown) to the respective ends of the transverse shaft 56, on the outer sides of the mounting plates 38. Each of the drive pulleys 60 drives rotation of the shaft 56 when rotated in a first direction (clockwise as viewed in FIG. 2) relative to the shaft 56, while allowing the shaft 56 to freewheel when the drive pulley 60 is rotated in the opposite direction relative to the shaft 56. Thus, the shaft 56 sums the rotational motion of the two drive pulleys 60.

The linkage assembly 20 couples the left and right levers 14 and 16 and drives rotation of the drive pulleys 60, and thus the flywheel 46. In the preferred embodiment illustrated in FIGS. 1 and 2, the linkage 20 includes left and right drive cables 62. Each drive cable 62 is connected from the corresponding left lever 14 or right lever 16 and the corresponding left or right drive pulley 60. Specifically, referring to the connection of the left lever 14 shown in FIG. 2, a first end of the left drive cable 62 is secured to the step platform 44, while the other end of the left drive cable 62 is wrapped around the left drive pulley 60 in a counterclockwise direction and secured at a point 64 to the left drive pulley 60. The right drive cable 62 is similarly connected between the right lever 16 and the right drive pulley 60.

Referring to FIGS. 1, 2, and 3, the extension limiting cable 24 couples the two drive pulleys 60, and thus the left and right levers 14 and 16. The extension limiting cable 24 includes interconnected left end section 65, intermediate section 66, and right end section 68. The left end section 65 of the extension limiting cable 24 has one end secured to, and wrapped around, the left drive pulley 60 in the direction opposite of the left drive cable 62. The opposite end of the left end section 65 is secured to one end of the intermediate section 66, as shown in FIG. 3. The joined ends of the left end section 65 and intermediate section 66 of the extension limiting cable are looped around each other as well as a hook formed on one end of the spring 22, and each looped cable section is secured by a crimp 70. The intermediate section 66 of the extension limiting cable 24 passes axially through the hollow center of the elongate coil spring 22.

The opposite end of the intermediate section 66 of the extension limiting cable 24, as well as the opposite end of the coil spring 22, are secured in similar fashion to one end of the right end section 68 of the extension limiting cable 24. The opposite end of the right end section 68 of the extension limiting cable 24 is wrapped around and secured to the right drive pulley 60.

By virtue of the intermediate section 66 of the extension limiting cable 24 passing through the interior of the coil spring 22, the intermediate section 66 of the cable and the spring are engaged in loose contact with each other, along the entire length of the spring. Referring to FIGS. 1 and 2, the coil spring 22, containing the intermediate section 66 of the extension limiting cable 24, is trained around a series of idler pulleys between the drive pulleys 60. A pair of first idler pulleys 72 are rotatably mounted on opposite sides of the center beam 26 of the frame 12 to rotate about a transverse axis 74 disposed below the drive shaft 56. A pair of second idler pulleys 76 are mounted side-by-side on the rearward face of the upper post assembly 32, above and on opposite sides of the step-up pulley 54.

The extension limiting cable 24 and coil spring 22 of the linkage 20 thus pass from the left drive pulley 60, downwardly to train around the left first idler pulley 72 then back upwardly to train over the top of both second idler pulleys 76, then again back down to train around the right first idler pulley 72, and back up to the right drive pulley 60. In this manner, a relatively large length of coil spring 22 is accommodated.

Referring to FIG. 3, the intermediate section 66 of the extension limiting cable 24 has a length that is greater than the nondeformed, relaxed length of the coil spring 22. Thus, when the coil spring 22 is in its relaxed configuration, as shown in FIG. 3, the intermediate section 66 of the extension limiting cable 24 is slack. When a sufficient differential force is exerted on one of the levers 14 or 16 relative to the other of the levers 14 or 16, the spring 22 is caused to elongate, thereby increasing the overall length of the spring 22, as well as the length of the linkage 20. However, the spring 22 can be elongated only to the extent permitted by the intermediate section 66 of the extension limiting cable 24. FIG. 4 illustrates the spring 22 at the maximum elongation permitted by the intermediate section 66 of the tautly drawn extension limiting cable 24.

The linkage 20 acts to urge the left lever 14 and right lever 16 to reciprocate in a substantially synchronous action. Thus, when the left lever 14 is depressed to the displaced position, the linkage 20 urges the right lever 16 to rise to the nominal position, and vice-a-versa. The extension limiting cable 24 is preferably dimensioned such that when one lever 14 or 16 is fully depressed to the displaced position, the opposite lever 14 or 16 is fully raised to the nominal position, and the intermediate section 66 of the cable is drawn taut. In this normal use configuration, with the levers 14 and 16 at opposing extremes of travel, the coil spring 22 is elongated and the extension limiting cable 24 is drawn taut, as shown in FIG. 4.

Thus, during a substantial portion of use of the apparatus 10, the left and right levers 14 and 16 are linked in dependent fashion. However, when the exerciser reduces the downward resistance exerted against an upwardly moving lever, or lifts the upwardly moving leg at a greater rate than at which the opposing leg is depressed, the previously extended coil spring 22 retracts toward its relaxed configuration, shortening the linkage 20. The retraction of the spring causes the upwardly moving lever to follow the motion of the rising limb, even when the rising limb is somewhat out of synchronization with the depression of the opposite limb and lever. Thereafter, depression of the lever that has just been raised results in extension of the spring 22 until the extension-limiting cable 24 is again drawn taut, after which the opposite lever is caused to travel upwardly.

The presence of the coil spring 22 within the linkage 20 enables the onset of downward travel of a lever from the upper, nominal position toward the displaced position without requiring an instantaneous upward travel of the opposite lever from the displaced position. This results in a smooth transition of lever movement without the instantaneous imposition of an upward jerk on the opposing lever. The spring 22 thus serves to absorb the shock that might otherwise be imparted to an exerciser's extended limb upon the onset of motion of the other limb in the downward direction.

As discussed above, routing of the coil spring 22 about the idler pulleys 72 and 76 allows the accommodation of a greater spring length. The preferred embodiment illustrated utilizes a spring having a relaxed length of about 30 to 40 inches, and preferably about 35 inches. The total extension of the spring permitted by the extension-limiting cable 24 is preferable from about 6 to about 8 inches, thereby providing for a corresponding amount of non-synchronous travel between the levers 14 and 16. This corresponds to a maximum elongation of the spring 22, from the relaxed to the extension-limited, of between about 17 and 23 percent. Limiting maximum spring elongation to less that 25 percent is desired to extend the life of the spring.

However, it will be readily apparent to those of skill in the art that springs of much greater or shorter lengths could be utilized in practice of the present invention. For example, a much shorter spring could be trained around a single pulley, for example, although the incidence of wear and eventual breakage would likely increase. the can be varied by those of skill in the art to achieve an apparatus with a greater or lesser degree of permitted non-synchronous motion.

Other variations to the preferred embodiment discussed above are possible. For example, other types of resilient members, such as an elastomeric cord, can be utilized in place of the coil spring 22. In the preferred embodiment discussed above, the extension limiting cable is threaded through the spring interior. However, the extension-limiting cable can instead be loosely tied to the outside of either a coil spring, elastomeric cord, or other resilient member at several points along the member's length. Further, rather than using an extension limiting cable, a loosely woven fiber sleeve can be placed around the resilient member, with the sleeve being drawn down in diameter as the resilient member is elongated until the sleeve tightly surrounds the resilient member, and thereby limits further elongation of the resilient member.

The exercise apparatus 10 has been described above as utilizing "cables" 24 and 62. As used herein throughout, the term "cable" is meant to include not only wire cables, but other elongate linkages, such as ropes, straps, cords, and chains. If a chain is utilized, it will be readily apparent that sprockets are used in place of the various drive and idler pulleys.

Still other variations in construction of the linkage 20 of the apparatus 10 will be apparent to those of skill in the art based on the disclosure contained herein. For example, rather than including separate drive cables 62 and extension-limiting cable 24, a single continuous cable interconnecting the levers 14 and 16 can be used. Likewise, instead of constructing the extension-limiting cable from a separate intermediate section 66 and end sections 65 and 68, a single length of cable may be passed through the spring 22 and knotted or otherwise affixed to the spring 22 at either end.

As a further example of an alternate construction for the apparatus 10, it will be apparent that resistance mechanisms other than eddy current brakes, such as shock absorbers or fans, may be employed. If shock absorbers are utilized, a single shock absorber may be connected between one of the levers 14 or 16 and the frame, or separate shock absorbers can be mounted between each of the levers and the frame. Depending on the resistance mechanism utilized and the need to drive rotating members, the coil spring utilized can be increased in length to extend fully from one lever to the other.

Figure 5:
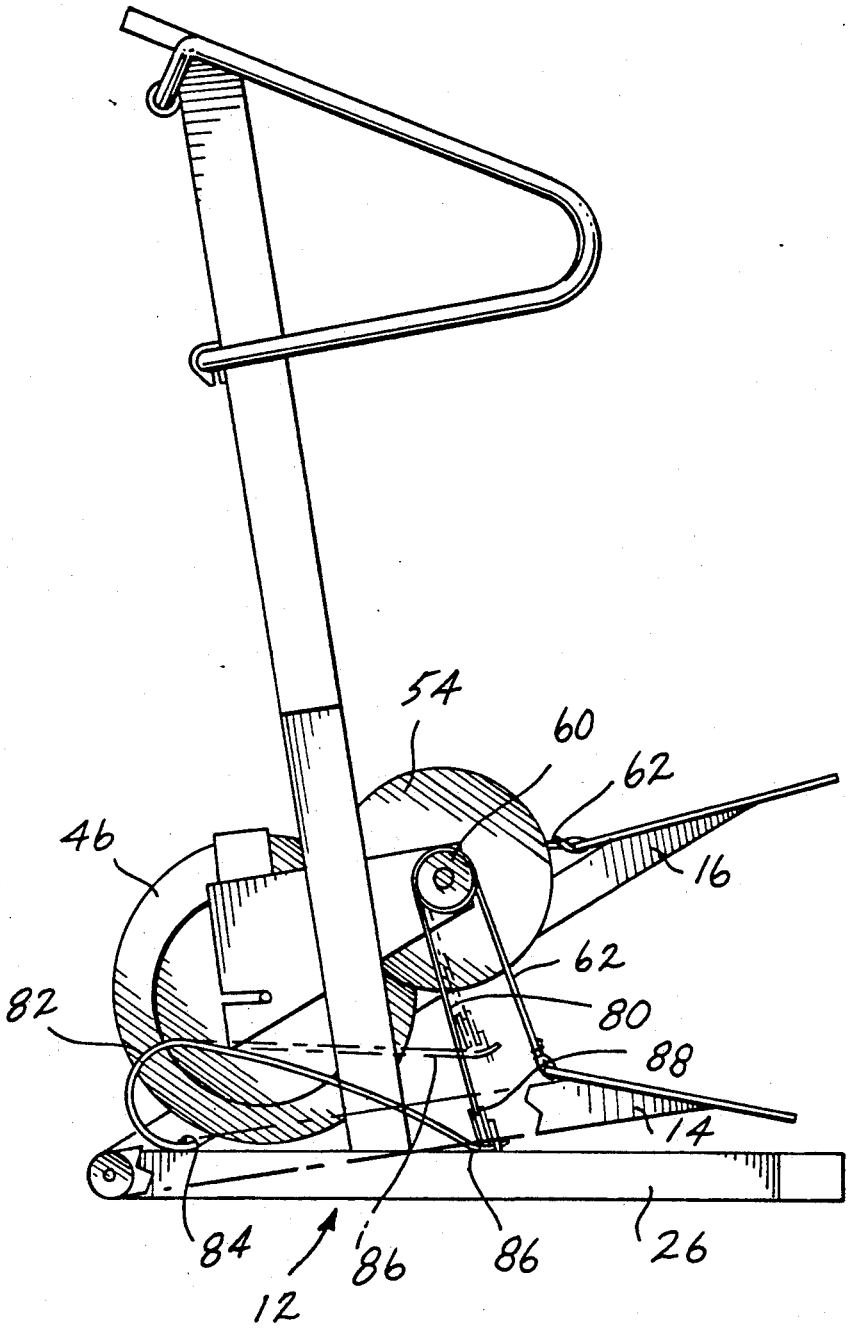
FIG. 5 provides a side elevation view of an alternate embodiment of an exercise apparatus constructed in accordance with the present invention, wherein an interconnection cable trains around an idler pulley mounted to a leaf spring, with the leaf spring shown in its normal, pre-loaded position and also shown in phantom line in its deflected configuration.

An alternate embodiment of an exercise apparatus 78 for providing semi-dependent action is shown in FIG. 5. The exercise apparatus 78 is substantially identical to the previously described exercise apparatus 10, with the exception of the linkage. The same part numbers are used to identify similar components and features, and duplicate detailed description of those common aspects foregone. The exercise apparatus 78 includes left and right reciprocating levers 14 and 16 pivotally secured to a frame 12. As previously described, the levers 14 and 16 are connected by left and right drive cables 62 to corresponding left and right drive pulleys 60 to drive rotation of a flywheel 46. The pulleys 60 are connected by an intermediate cable 80 having a first end wrapped around and secured to the left drive pulley 60 and a second end wrapped around and secured to the second drive pulley 60 (not shown).

The apparatus 78 further includes a leaf spring 82 having a first bent-over end 84 secured to the forward end of the center beam 26 of the frame 12. The leaf spring 84 projects forwardly from the point of connection to the frame 12, and then curves upwardly and rearwardly back over the center beam 26, terminating in a rearward, second end 86. The leaf spring 82 is preloaded such that the rearward end 86 nominally bears downwardly against the center beam 26 of the frame. Preferably, the leaf spring is preloaded with approximately 15 pounds of pressure. An idler pulley 88 is rotatably mounted on the upper surface of the rearward end 86 of the leaf spring 82. The intermediate cable 80 is trained about the idler pulley 88, thereby engaging the rearward end 86 of the spring with the intermediate cable 80.

The intermediate cable 80 acts to link the first and second levers 14 and 16 together for synchronous motion, such that each of the left and right levers 14 and 16 moves to its respective upper, nominal position when the other of the left and right levers 14 and 16 is moved to its respective lower, displaced position. Normally, the rearward end 86 of the leaf spring 82 remains either sprung downward against the center beam 26, or raised slightly above the center beam 26, during operation of the apparatus. This normal in-use position of the spring 82 will vary somewhat depending on the stride of the exerciser. When the exerciser exerts a sufficient differential force on one of the levers 14 or 16 relative to the other lever, the spring 82 is further deformed to raise the rearward end 86 further upwardly above the center beam 26, thereby enabling a limited nonsynchronous relative motion of the levers 14 and 16.

For instance, the lever 14 is shown fully depressed in FIG. 5. If in this configuration a sufficient downward force is exerted on the right lever 16 before downward resistance is removed from the depressed left lever 14, the second end 86 of the spring 82 rises to the position shown in phantom in FIG. 5. Because of this deflection, the right lever 16 is able to travel downwardly without requiring an instantaneous corresponding upward movement of the left lever 14. Once the exerciser lifts his or her left leg, allowing the left lever 14 to rise an amount corresponding to the extent of downward motion of the right lever 16, the second rearward end 86 of the spring 82 returns down to its original position proximate to the top surface of the center beam 26.

Figure 6:
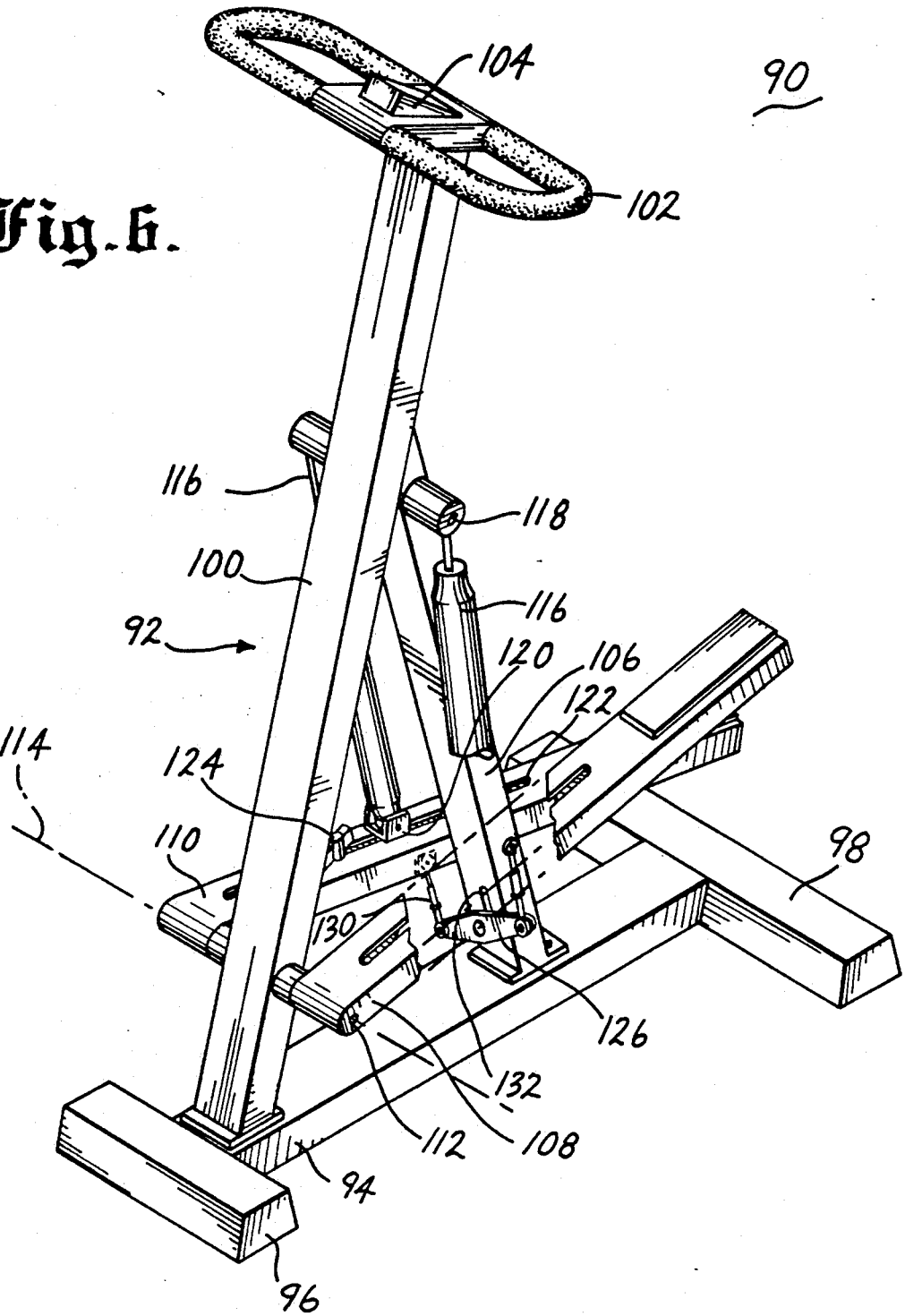
FIG. 6 provides a pictorial view of a second alternate embodiment of an exercise apparatus constructed in accordance with the present invention, wherein first and second levers are coupled by a floating rocker arm mechanism, with one lever shown partially broken away for clarity.
Figure 7:
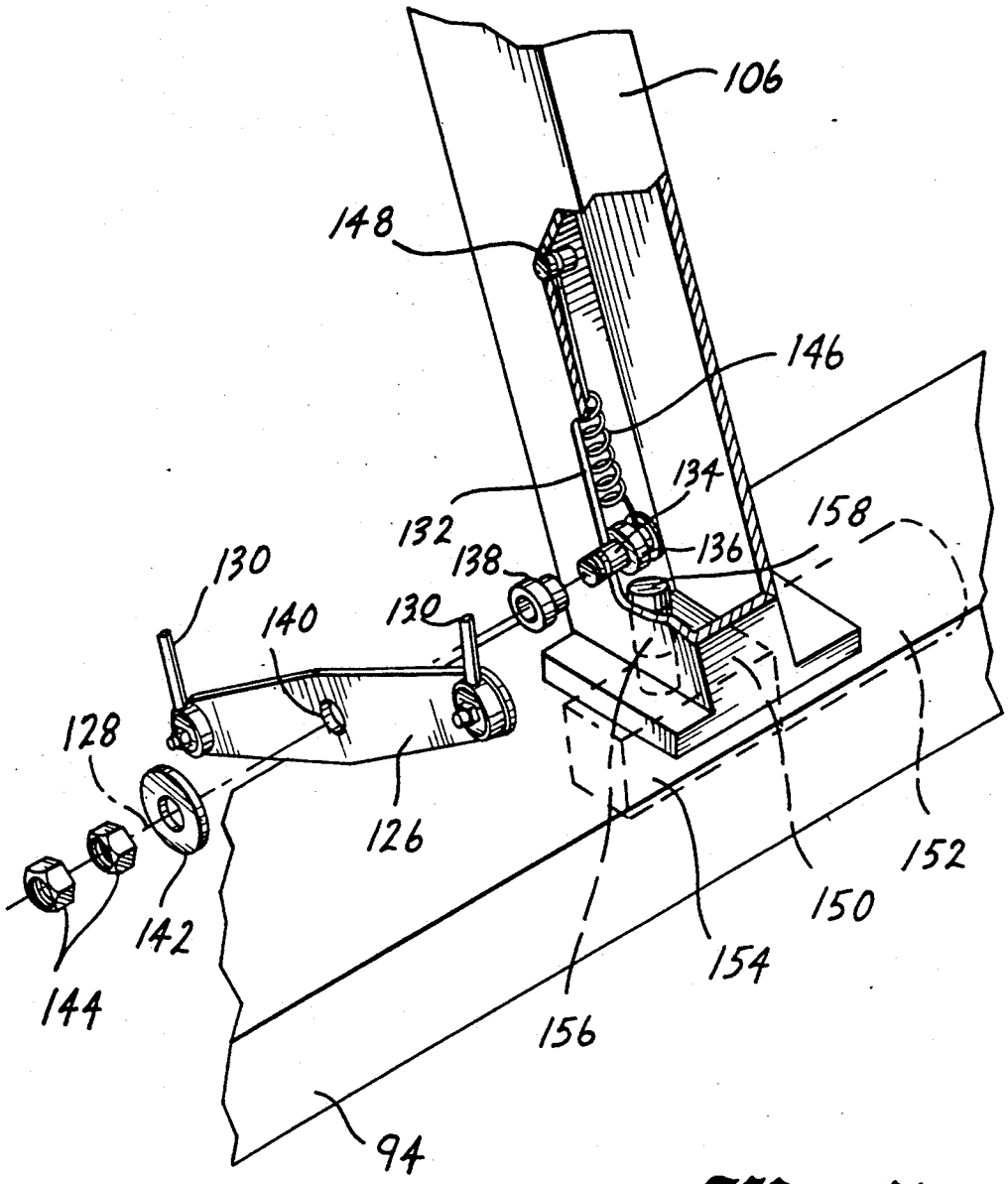
FIG. 7 provides a partial exploded view of the rocker arm mechanism of the exercise apparatus of FIG. 6, with a portion of the upright frame member broken away to show the internal spring-mounting mechanism for the rocker arm, and with the adjustable stop mechanism illustrated in phantom housed within the base of the frame.

A further embodiment of an exercise apparatus 90 constructed in accordance with the present invention is shown in FIGS. 6 and 7. The exercise apparatus 90 includes a resiliently mounted linkage to provide for a semi-dependent action. Referring initially to FIG. 6, the apparatus 90 includes a frame 92 having a base formed from a longitudinal center beam 94, and forward and rearward transverse beams 96 and 98, respectively, secured across the ends thereof. A first upright beam 100 projects upwardly and is inclined rearwardly from the forward end of the center beam 94. Handlebars 102 are secured to the upper end of the first upright beam 100, and project outward from opposite sides thereof. An electronic exerciser interface 104, housing control circuitry including a microprocessor (not shown), is also mounted to the top of the first upright beam 100.

The frame 92 is completed by a second upright beam 106 projecting upwardly from the center beam 94 at a location between the transverse beams 96 and 98, and forwardly to intersect the first upright beam 100 at a location above the base. Although other structural materials may be used, the frame members 94 through 100 and 106 are suitable constructed from hollow structural tubing.

The forward ends of the left and right levers 108 and 110, respectively, are pivotally mounted on a transverse shaft 112 extending through the first upright beam 100 at an elevation spaced above the center beam 94. The left and right levers 108 and 110 reciprocate between a nominal, raised position, in which the left lever 108 is shown in FIG. 6, and a displaced, lower position, in which the right lever 110 is shown. The transverse shaft 112 defines a transverse pivot axis 114 about which the left and right levers 108 and 110 reciprocate.

The exercise apparatus 90 includes a resistance mechanism for resisting rotation of the left and right levers 108 and 110. Linear resistance mechanisms, such as left and right shock absorbers 116, are connected between the frame 92 and the levers 108 and 110. The upper ends of the shock absorbers 116 are pivotally secured to the opposite ends of a transverse shaft 118 extending through the second upright frame member 106 at an elevation above the lever pivot axis 114. The lower ends of the shock absorbers 116 are pivotally coupled to the corresponding levers 108 or 110 by mounting yokes 120. Each mounting yoke 120 is slidably secured in a slot 122 formed longitudinally through the upper wall of a corresponding lever 108, 110. The slidable position of the yoke 120 in the slot 122 is adjusted by a linked adjustment knob 124 in a manner more fully described in U.S. Pat. No. 4,838,543 to Armstrong et al., the disclosure of which is hereby incorporated by reference. It should also be apparent that other resistance mechanisms could be used in place of the shock absorber 116, such as those previously described herein above.

The levers 108 and 110 are coupled by a linkage assembly including a rocker arm 126. Referring to FIGS. 6 and 7, the rocker arm 126 is pivotally secured, in a manner to be described subsequently, at its midpoint to the second upright member 106 to pivot about a rocker arm pivot axis 128. The rocker arm pivot axis 128 is oriented generally parallel to the longitudinal axis of the center beam 94, and generally perpendicular to the lever pivot axis 114.

The left and right distal ends of the rocker arm 126 are pivotally coupled to the left and right levers 108 and 110, respectively, by tie-rod couplers 130. The exact construction and connection of the tie-rods 130 is more fully described in U.S. Pat. No. 4,830,362 to Bull, the disclosure of which is hereby incorporated by reference.

The pivotal mounting of the rocker arm 126 shall now be described with reference to FIG. 7. A vertically disposed slot 132 is formed through the forward face of the second upright beam 106, in proximity to the center beam 94 of the frame. A threaded stud 134 is inserted into the hollow interior of the second upright beam 106 during assembly of the frame. The shaft portion of the stud 134 projects forwardly and outwardly through the slot 132, while the head of the stud 134 is retained within the second upright beam 106.

A washer 136, made from a low friction material such as nylon, is received on the stud 134 within the interior of the second upright member 104. A bushing 138, also constructed from a low-friction material, is inserted over the projecting end of the stud 134. A turned-down rearward end portion of the bushing 138 extends through the slot 132. The projecting end of the stud 134 and a turned-down forward end portion of the bushing 138 are received within a close-fitting aperture 140 formed in the center of the rocker arm 126. The rocker arm 126 is secured in place by a flat washer 142 and nuts 144, or other conventional fasteners. The rocker arm 126 thus pivots substantially without friction on the stud 134. It should be appreciated that bearing assemblies other than those described above may be utilized, as is well known by those of skill in the art.

The rocker arm 126 is resiliently mounted on the second upright beam 106 by a coil spring 146. In the preferred embodiment, the coil spring 146 is housed within the second upright beam 106, although it should be apparent that it could also be housed externally. The upper end of the coil spring 146 is secured to the second upright beam 106 by an inwardly projecting stud 148, press-fit or otherwise secured through an aperture in the upright beam member 106. The lower end of the coil spring 146 is secured to the stud 134 adjacent the head of the stud, such as by passing the looped lower end of the spring through a transverse aperture (not shown) formed through the stud.

The rocker arm 126 is thereby resiliently mounted on the second upright beam 106 for slidable vertical movement. A downward force exerted on the rocker arm 126 sufficient to overcome the force of the spring 146 results in extension of the spring 146 and downward movement of the stud 134 within the slot 132.

Referring again to FIG. 6, in normal operation the rocker arm 126 constrains the left and right levers 108 and 110 to reciprocate in synchrony. However, when a differential force is exerted on the left lever relative to the right lever, the spring 146 is caused to deform (elongate), permitting the rocker arm 126 to move downwardly. The pivot axis 128 of the rocker arm 126 thus is able to "float" up and down relative to the lever pivot axis 114, thereby permitting a limited degree of non-synchronous motion of the left and right levers 108 and 110.

Referring to FIG. 6, after a stride is completed, the right lever 110 is displaced downwardly, while the left lever 108 is disposed upwardly in the nominal position. If a sufficient downward force is exerted on the left lever 108 before the exerciser raises his or her right limb to permit the right lever 110 to raise correspondingly, the right lever remains stationary while the left lever and rocker arm 126 move downwardly. Downward movement of the rocker arm 126 is permitted by elongation of the spring 146. Once the exerciser begins to raise his or her right limb, the right lever 110 and rocker arm 126 return back upwardly.

The nominal location of the pivot axis 128 of the rocker arm 126 will depend upon the exact stride of the exerciser. The resiliently mounted rocker arm 126 serves to avoid jerking motion of the levers at the transition between rising and falling motion. The spring 146 absorbs shock at these transitions, and provides a more fluid motion for the exerciser.

The exercise apparatus 90 further includes an adjustable stop mechanism 150, illustrated schematically in FIG. 7, for limiting the elongation permitted of the spring 146, and thereby also the degree of travel of the rocker arm 126. The stop mechanism 150 includes a motor 152, gear box 154, and piston 156. The piston 156 projects upwardly below the stud 134, and is capped with an elastomeric pad 158. The motor 152 is automatically operated by control circuitry included in the electronic exerciser interface 104 to raise and lower the piston 156.

By raising the piston 156 above the bottom end of the slot 132, the downward travel of the stud 134 is limited by contact with the elastomeric pad 158. If the piston 156 is fully extended so as to lock the stud 134 at the upper end of the slot 132, the rocker arm 126 no longer is capable of travel, and the levers 108 and 110 are linked for fully dependent action. By lowering the piston 156 from this position, a proportionate degree of elongation of the spring 146, and thus non-synchronous motion of the levers is permitted.

It should be apparent that rather than using a motor to power adjustment of the stop mechanism, a manually adjustable stop mechanism could be utilized. For example, a pin (not shown), could be inserted into a plurality of apertures (not shown) formed transversely through the second upright beam 106. The pin would be inserted at the desired point and act as a stop to limit travel of the stud 134.

The previously described exercise apparatus 90 may be constructed with a variety of different resilient mounting mechanisms to enable the rocker arm 126 to float, thereby permitting non-synchronous motion of the levers. Several possible alternate embodiments of resilient mounting mechanisms suitable for use in the exercise apparatus 90 are shown in FIGS. 8 through 11. Other than the mounting mechanisms, the remainder of the exercise apparatus 90 is unchanged from that previously described and illustrated in FIGS. 6 and 7. Thus, description of the construction of the frame, levers, and rocker arm assembly is not repeated in order to avoid redundancy. Parts which are identical to those shown in FIG. 7 are referred to by the same part numbers.

Figure 8:
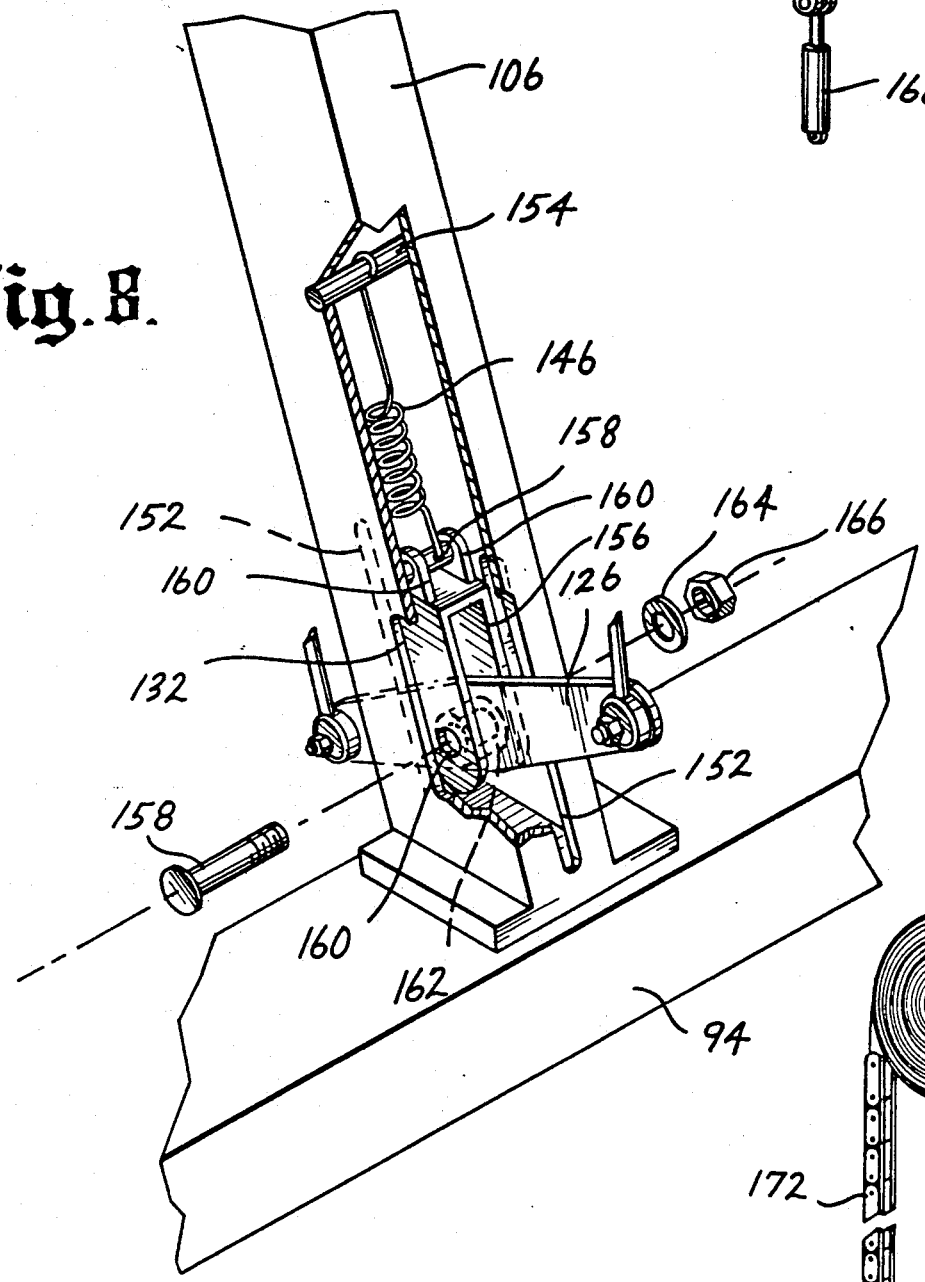
FIG. 8 provides a partial exploded view of an alternative rocker arm mounting mechanism of an exercise apparatus otherwise constructed as shown in FIG. 6, with the rocker arm mounted internally of the upright frame member.

Referring initially to FIG. 8, an alternate embodiment of a resilient mechanism for mounting the rocker arm 126 is shown. Rather than mounting the rocker arm 126 externally of the second upright beam 106, the rocker arm 126 is mounted internally within the upright beam 106. To this end, two opposing vertical slots 152 are formed through the sides of the second upright beam 106. The ends of the rocker arm 126 project outwardly through corresponding slots 152. The rocker arm 126 is suspended from a coil spring 146. The upper end of the coil spring 146 is secured to a pin 154 inserted across the interior of the upright beam 106. The lower end of the spring 146 is connected to the rocker arm 126 by a clevis 156. Particularly, the lower end of the spring 146 is secured to a pin 158 that is inserted between two spaced-apart flanges 160 projecting upwardly from the clevis 156.

A bolt 158 is inserted through the slot 132 formed in the forward face of the upright beam 106. The bolt 158 passes through aligned holes 160 formed transversely through the downwardly depending side flanges of the clevis 156. The rocker arm 126 is journaled by a bearing 162 on the shank of the bolt 158 between the flanges of the clevis 156, so that the rocker arm 126 is securely captured within the clevis and is free to pivot on the bolt 158. The other, threaded end of the bolt 158 passes through a vertical slot (not shown) formed through the rearward face of the upright beam 106 in alignment with the opposing slot 132 formed through the forward face thereof. A washer 164 and nut 166 are then secured to the threaded end of the bolt 158. The rocker arm 126 and clevis 156 thus are able to float upwardly and downwardly upon contraction and expansion of the spring 146, as previously described with regard to FIG. 7.

Figure 9:
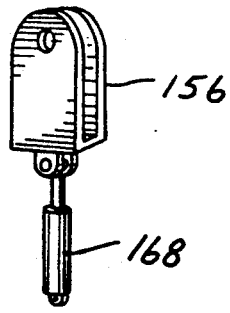
FIG. 9 is a schematic side elevation view showing an alternate resilient connection of a rocker arm to a gas spring for resiliently mounting the rocker arm as otherwise shown in FIG. 8.

Alternate resilient mechanisms can be used to mount the clevis 156 shown in the apparatus of FIG. 8. Particularly, FIG. 9 illustrates the use of a gas spring to mount the clevis 156. In the example shown, the gas spring is configured to resist compression. The clevis is mounted upside down from the configuration shown in FIG. 8, and is connected to the upper end of the gas spring 168. The lower end of the gas spring is pinned or otherwise secured to the central frame member 94. It should be apparent that the clevis 156 could alternately be suspended from a gas spring (not shown) configured to resist elongation.

Figure 10:
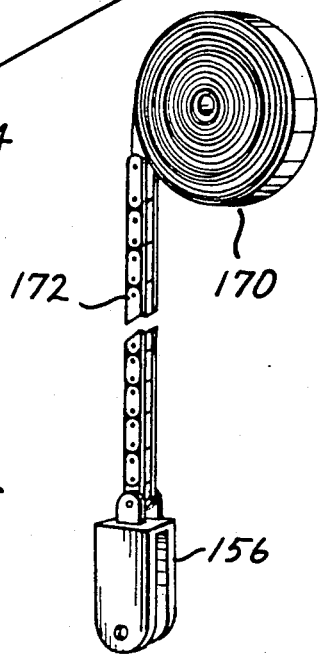
FIG. 10 is a schematic side elevation view showing an alternate resilient connection of a rocker arm on a radial spring for resiliently mounting the rocker arm as otherwise shown in FIG. 8.

Another alternate resilient mounting for the clevis 156 shown in FIG. 8 is illustrated in FIG. 10. In place of the coil spring 146, a radial spring 170 is mounted on the cross-pin 154. The other, free end of the radial spring 170 is connected by a chain 172 to the clevis 156. It should be apparent that in place of the chain 172, a cable, rod or other elongate member could be used.

Figure 11:
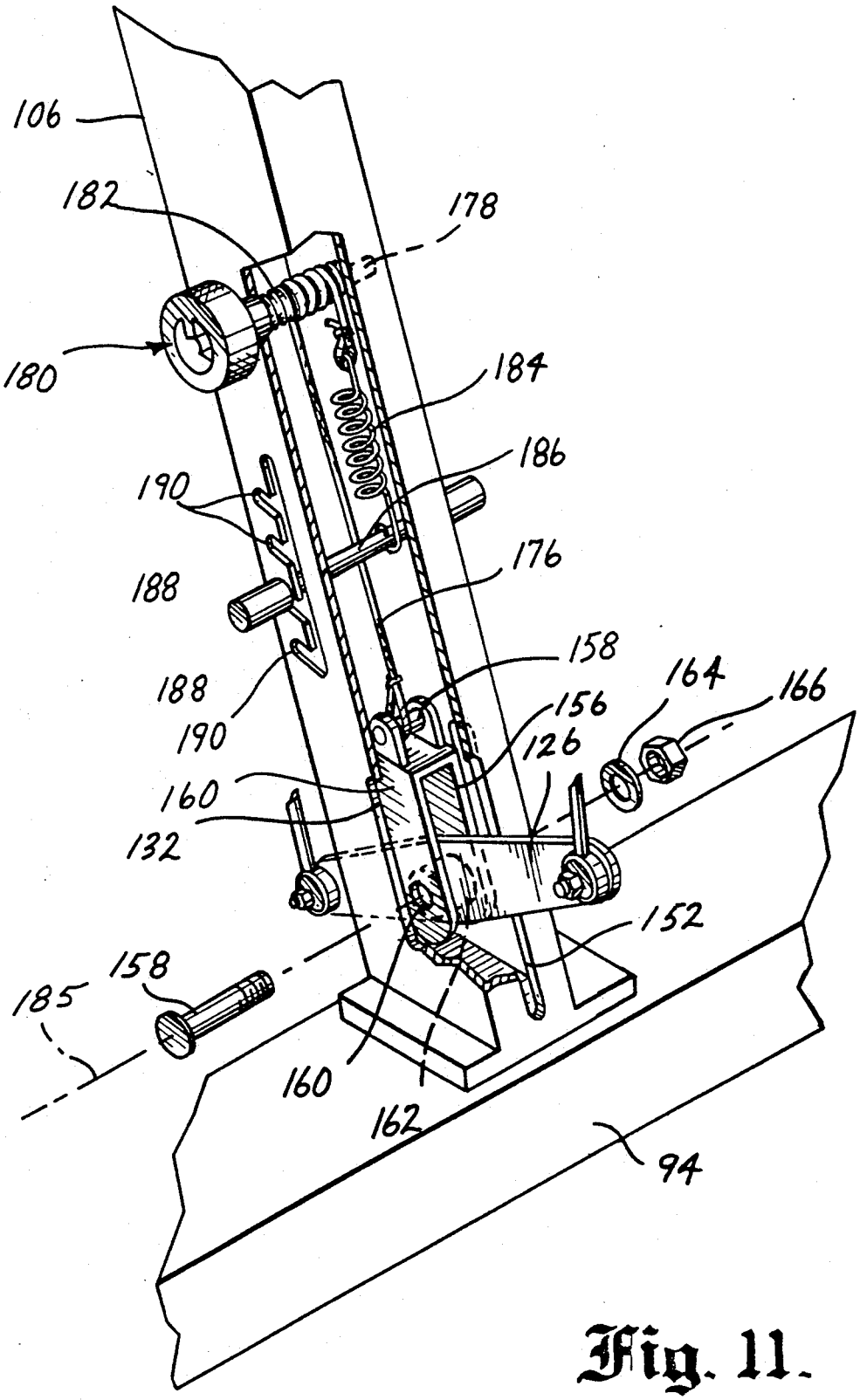
FIG. 11 provides a pictorial view of an alternate spring mounting mechanism for the exercise apparatus of FIG. 6, wherein resistance of the coil spring from which the rocker arm is suspended is selectively adjustable and excludable.

A still further alternate embodiment of a resilient mounting mechanism for use with the exercise apparatus 90 shown in FIG. 8 is illustrated in FIG. 11. Again, to avoid redundancy like parts are given like numbers, and those elements in common are not again described. A rocker arm 126 is pivotally secured on a bolt 158 supported by a clevis 156. The clevis 156 is suspended from the lower end of a cable 176 by a cross-pin 158. A cross-shaft 178 is journaled within bearings (not shown) across the interior of the upright beam 106 at an elevation above the vertical slots 132 through which the bolt 158 is inserted. A spiral-grooved pulley 182 is fixedly and axially secured on the shaft 178 within the interior of the cross-beam 106. The cable 176 is trained about the pulley 182. The other end of the cable 176 is secured to the upper end of a coil extension spring 184. The lower end of the coil spring 184 is secured to a cross-pin 186 that is inserted through forward and rearward (not shown) vertical slots 188 defined through the forward and rearward faces, respectively, of the second upright beam 106, below the shaft 178 and above the vertical slots 132. The position of the pin 186 within the slots 188 is adjustable, as described below.

For normal, "floating" operation, the shaft 178 freely rotates, so that downward movement of the rocker arm 126 is resisted by extension of the coil spring 184. The exercise apparatus utilizing the resilient mounting mechanism shown in FIG. 11 thus operates similarly to that shown in FIG. 8. The axis 185 of the bolt 158 on which rocker arm 126 is pivotally mounted is thus able to float up and down for limited non-synchronous motion of the exercise apparatus foot levers.

The resistance offered to downward travel of the rocker arm 126 may be adjusted by selectively positioning the pin 186. Each of the vertical slots 188 defines a plurality of upwardly angled detents 190. The detents 190 thus form a vertical series of stops in which the pin 186 may be selectively positioned, thereby increasing or decreasing the nominal amount of extension of the spring 184, and the amount of upward biasing placed on the bolt 158 on which the rocker arm 126 is mounted. The lower the slot 190 selected, the greater the resistance to downward travel of the rocker arm 126.

Additionally, a selective locking mechanism 192 is secured to the forward face of the upright beam 106, and selectively engages the corresponding end of the shaft 178 to lock the shaft 178, and thus the pulley 182, against rotation. The locking mechanism 192 is spring-loaded, and includes a key 193 that is inserted within a corresponding keyway (not shown) on the end of the shaft 178 upon selective rotation of the mechanism 192. When so locked, the cable 176 is fixedly retained by friction against the pulley 182, thereby preventing extension of the spring 184 and downward travel of the rocker arm 126. Thus, by engaging the selective locking mechanism 192, the spring 184 is isolated from the remainder of the mounting mechanism, and the rocker arm 126 is secured at a fixed elevation for fully dependent, synchronous motion of the exercise apparatus levers.

While several preferred embodiments of the invention and variants thereof have been illustrated and described, it will be appreciated that various other changes, alterations and substitutions can be made therein without departing from the spirit and scope of the invention. Therefore, it is intended that the scope of letters patent granted hereon be limited only by the definitions of the appended claims and the equivalents thereof.

The embodiments of the invention in which an exclusive property or privilege is claimed are defined as follows:

1. An exercise apparatus, comprising:

a frame;

first and second members mounted on the frame for reciprocal motion between a nominal position and a displaced position when operated by an exerciser's first and second limbs, respectively;

resistance means acting on at least one of the first and second members for resisting motion of the first and second members; and a synchronizing linkage coupling the first and second members to urge each of the first and second members to its respective nominal position when the other of the first and second members is in its displaced position, wherein the linkage includes:

a resilient component having a first end portion coupled to the first member and a second end portion coupled to the second member, the resilient component being deformable to permit limited non-synchronous motion of the first and second members; and a fixed-length component having a first end and a second end coupled to the first and second end portions, respectively, of the resilient component to limit deformation of the resilient component, whereby the synchronizing linkage constrains the first and second members to reciprocate in synchrony when the fixed length component is operable to limit deformation of the resilient component.

2. The exercise apparatus of claim 1, wherein the fixed length component of the linkage has a length greater than the non-deformed length of the resilient component.

3. The exercise apparatus of claim 2, wherein the resilient component of the linkage comprises a coil spring.

4. The exercise apparatus of claim 3, therein the linkage includes a cable and the fixed-length component of the linkage comprises an intermediate section of the cable.

5. The exercise apparatus of claim 4, wherein the intermediate section of the cable is engaged with the spring along the length of the spring.

6. The exercise apparatus of claim 5, wherein the intermediate section of the cable is threaded through the interior of the spring.

7. The exercise apparatus of claim 5, further comprising at least a first pulley rotatably secured to the frame, wherein the spring is trained over the first pulley.

8. The exercise apparatus of claim 7, further comprising a pair of second pulleys rotatably secured to the frame on either side of the first pulley and spaced from the first pulley in the direction of motion of the first and second members, wherein the spring is also trained over the second pulleys.

9. The exercise apparatus of claim 4, wherein:
the resistance means include first and second rotary members rotatably secured to the frame; and
the cable includes first and second end sections extending from the first and second ends, respectively, of the intermediate section, wherein the first and second end sections of the cable driving engage the first and second rotary members, respectively.

10. The exercise apparatus of claim 4, wherein the linkage is constructed such that the cable normally remains taut during the majority of the distance through which the first and second members move.

11. The exercise apparatus of claim 3, wherein elongation of the spring is limited by the fixed-length component of the linkage to no more than 25 percent of the spring's relaxed length.

12. The exercise apparatus of claim 2, wherein the linkage is constructed such that the resilient component of the linkage is normally fully deformed to the extent permitted by the fixed-length component of the linkage during the majority of the distance through which the first and second members rotate.

13. The exercise apparatus of claim 1, wherein:
the resistance means includes first and second rotary members rotatably secured to the frame; and
the linkage includes first and second end portions, wherein the first and second end portions of the linkage driving engage the first and second rotary members, respectively.

14. An exercise apparatus, comprising:
a frame;
first and second levers pivotally mounted to the frame for reciprocal motion between a first position and a second position when operated by an exerciser's first and second limbs, respectively;
resistance means coupled to at least one of the first and second levers for resisting motion of the first and second levers;
a coil spring having a first end coupled to the first lever and a second end coupled to the second lever to urge each of the first and second levers to its respective first position when the other of the first and second levers is in its second position; and
an extension limiting member connected across the ends of the spring to limit the maximum extension of the spring, the extension limiting member having a length greater than the non-extended spring length, whereby the first and second levers are reciprocal in synchrony when the extension limiting member limits extension of the spring.

15. The exercise apparatus of claim 14, wherein the extension limiting member comprises a cable.

16. The exercise apparatus of claim 15, wherein the cable is engaged with the spring along the length of the spring.

17. The exercise apparatus of claim 14, wherein:
the resistance means include first and second rotary members rotatably secured to the frame; and
the extension limiting member includes a fixed-length portion connected across the ends of the spring and first and second end portions extending from the ends of the fixed-length portion, wherein the first and second end portions of the extension limiting member driving engage the first and second rotary members, respectively.

* * * * *

UNITED STATES PATENT AND TRADEMARK OFFICE

CERTIFICATE OF CORRECTION

PATENT NO. : 5,322,491

DATED : June 21, 1994

INVENTOR(S) : R. Wanzer et al.

It is certified that error appears in the above-indentified patent and that said Letters Patent is hereby corrected as shown below:

| COLUMN | LINE | |
|---|---|---|
| 7 | 60 | "crease. the can be" should read --crease. It should be apparent that the length and extent of extension of the spring can be-- |

Signed and Sealed this

Thirteenth Day of September, 1994

*Attest:*

*Attesting Officer*

BRUCE LEHMAN

*Commissioner of Patents and Trademarks*